United States Patent [19]

D'Aquanni

[11] 3,968,966

[45] July 13, 1976

[54] RACQUET WITH TWO INDEPENDENTLY STRUNG FACES

[75] Inventor: Cesare A. D'Aquanni, Pleasant Valley, N.Y.

[73] Assignee: The Raymond Lee Organization, Inc., a part interest

[22] Filed: May 5, 1975

[21] Appl. No.: 574,413

[52] U.S. Cl. ..... 273/73 D

[51] Int. Cl.[2] ..... A63B 51/06

[58] Field of Search ..... 273/73 R, 73 C, 73 D, 273/73 F, 73 G, 73 H, 67 R, 67 B, 76

[56] References Cited

UNITED STATES PATENTS

| | | | |
|---|---|---|---|
| 1,173,588 | 2/1916 | Larocque | 273/73 H |
| 1,502,845 | 7/1924 | Blache | 273/73 D |

FOREIGN PATENTS OR APPLICATIONS

| | | | |
|---|---|---|---|
| 252,990 | 7/1964 | Australia | 273/73 D |
| 855,902 | 2/1940 | France | 273/73 D |
| 1,212,195 | 10/1959 | France | 273/73 D |
| 3,528 | 2/1884 | United Kingdom | 273/73 D |
| 22,453 | 11/1901 | United Kingdom | 273/76 |
| 362,036 | 12/1931 | United Kingdom | 273/73 D |
| 409,924 | 5/1934 | United Kingdom | 273/73 D |
| 5,177 | 4/1885 | United Kingdom | 273/73 D |
| 252,480 | 6/1926 | United Kingdom | 273/73 H |
| 3,471 | 2/1902 | United Kingdom | 273/73 D |
| 4,445 | 2/1903 | United Kingdom | 273/73 H |
| 252,133 | 2/1970 | U.S.S.R. | 273/73 C |

*Primary Examiner*—Richard J. Appey

[57] ABSTRACT

An elongated band with a T-shaped cross section is bent into the form of an ellipse and is attached to a handle to form a tennis racquet frame of conventional proportions. The stem of the T faces inwardly along the periphery of the ellipse. Conventional racquet string is wrapped around the elliptical portion of the band to form two parallel faces, each face having the form of a flat rectangular grid.

6 Claims, 6 Drawing Figures

RACQUET WITH TWO INDEPENDENTLY STRUNG FACES

SUMMARY OF THE INVENTION

This invention is directed toward a racquet for tennis or the like that has a larger usable strung surface than a conventional racquet, while retaining the latter's proportions and size.

A conventional racquet is strung by passing strings through holes in the frame. The frame thus protrudes past the striking surface on either side, and can interfere with the proper striking of the ball if the ball is not properly centered on the striking surface. Even when the ball would ordinarily hit the strings, the frame may interfere.

In this invention, the problems posed by a protruding frame are eliminated, because the strings of this new racquet are wrapped around the frame, and not passed through it and form two faces. More particularly, two parallel string faces are formed, each having the form of a flat rectangular grid. Since the frame does not protrude beyond either face, the usable area of the strung surface is increased.

DETAILED DESCRIPTION OF PREFERRED EMBODIMENTS

Figure 1:
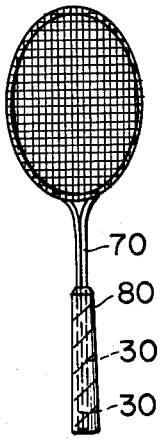
FIG. 1 is a front view of the invention.
Figure 2:
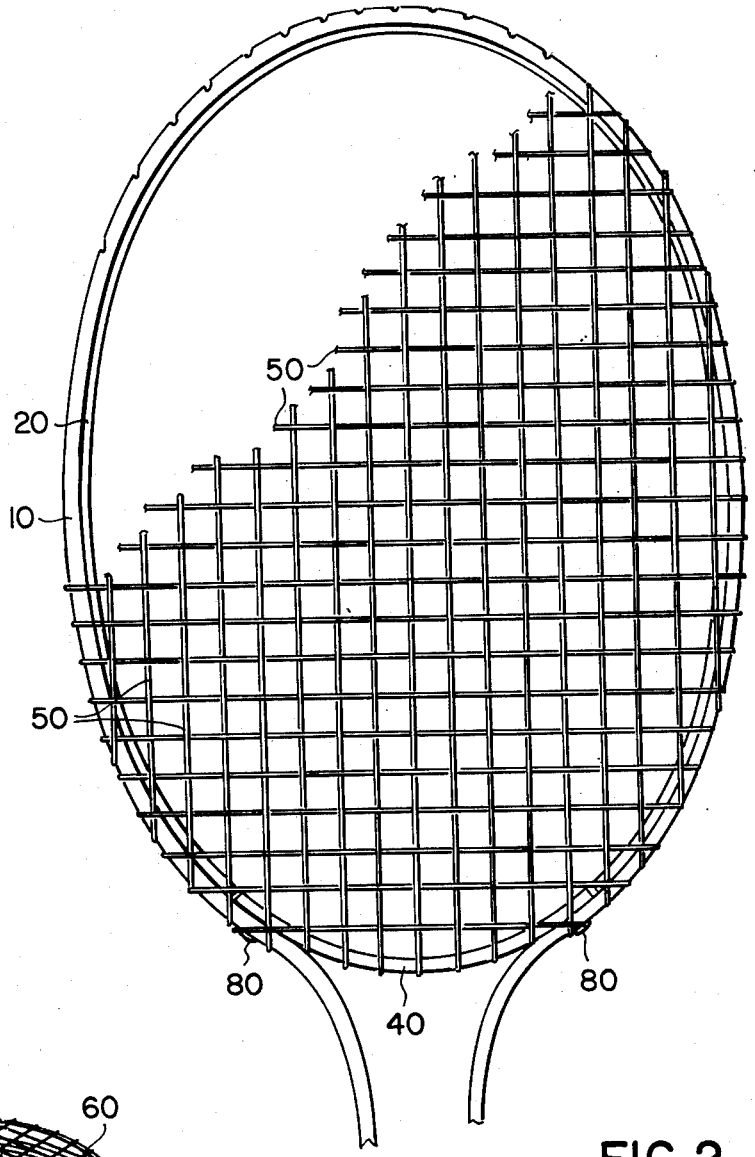
FIG. 2 is a front view of the elliptical portion of the invention.
Figure 3:
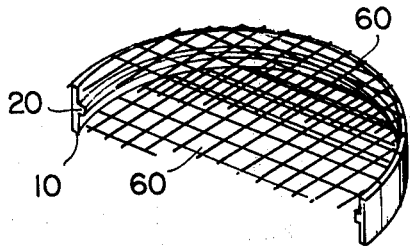
FIG. 3 is an elevation of a section of the elliptical portion of the invention.
Figure 4:
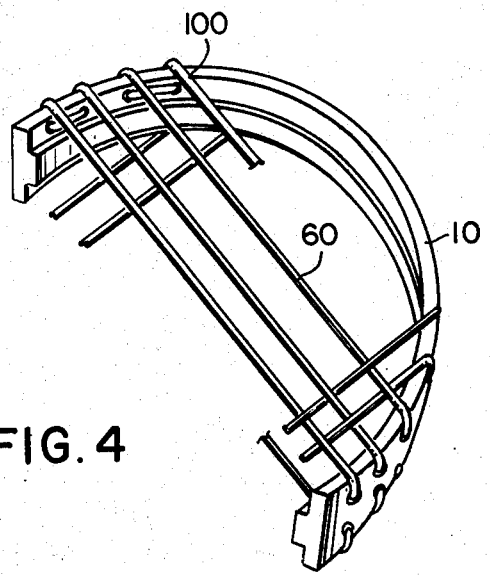
FIGS. 4, 5 and 6 are detail views illustrating the method and structure employed in stringing the invention.
Figure 5:
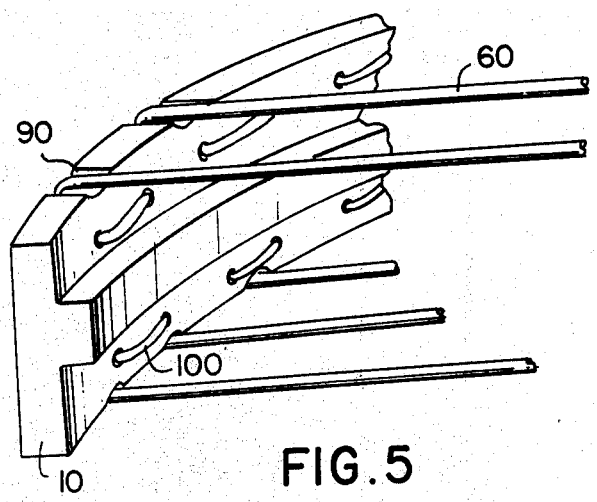
Figure 6:
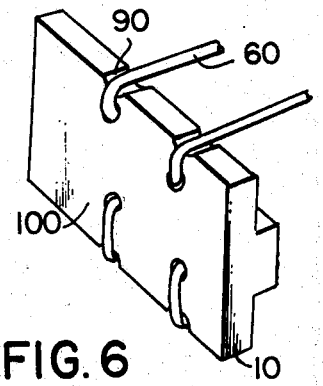

Referring FIGS. 1–6, an elongated metal band 10 is of constant width and has a T-shaped cross section. The band is bent into generally elliptical shape but the opposite ends are then moved into abutting position and extended in the plane of the ellipse to form an extension 10. A handle 30 has an axial bore 80 in which extension 70 is disposed and secured. The ellipse is thus not complete but is open adjacent extension 70. A curved metal strap 40 is riveted at each end to the bent band as shown at 80 to close the ellipse and provide appropriate reinforcement. The band is bent with the stem 20 of the T extending inwardly towards the center of the ellipse. This stem prevents warping or dimensional change in the racquet frame. The stem portions in extension 70 are abutting and can be welded together. The frame so formed is of conventional proportions and size. Aluminum, wood, steel, fiberglass, plastic or cast alloy can be used as different materials for the frame.

The racquet is strung with nylon or gut 50 by wrapping same around the elliptical portion of the band, to form two parallel flat faces 60 that take the form of rectangular grids. The stringing takes the form of two separate strings, one for each side. The strings are each held in place by groove 90, go around the frame through a hole 100 into the interior of the frame, out the adjacent hole and back across the same plane. The T-shaped cross section of the band enables the stringing to be drawn extremely taut.

The method of stringing has the following advantages: two separate strings whereby if one string breaks in play only one side need be repaired and better string stability. The racquet can be strung in the same manner as a conventional racquet.

Typically, the extension 70 is coincident with an extention of the major axis of the ellipse.

The principles of the invention are applicable to all types of racquets as used in all racquet sports.

Although the invention has been described with particular reference to the drawings, the protection sought is to be limited only by the terms of the claims which follow.

What is claimed is:

1. A racquet comprising:

a handle;

an elongated metal band bent generally into the form of an ellipse and attached to the handle to form a racquet frame;

string support means on the band; and two racquet strings supported by the string support means and wrapped around the elliptical portion of the band to form two parallel faces which are spaced apart from each other, each face having the form of a flat rectangular grid and being strung by a corresponding one of the strings in a manner at which each string forms the longitudinal and transverse runs of its respective face, thus forming two independently strung faces.

2. The racquet of claim 1 wherein said string support means includes:

two like sets of openings in the band, each set of openings being located adjacent a corresponding face for receiving the corresponding string that forms the face; and two like sets of grooves, each set of grooves lying across that periphery of the band around which a corresponding string is wrapped to form one of the faces, whereby each set of grooves keeps the string in a corresponding face aligned and thereby maintains the proper orientation of its longitudinal and transverse runs.

3. The racquet of claim 1 wherein the band has a T-shaped cross section.

4. The racquet of claim 3 wherein the stem of the T faces inwardly along the periphery of the ellipse.

5. The racquet of claim 4 wherein the lower portion of the elliptical portion of the band is closed off by a metal strap riveted to the band.

6. The racquet of claim 5 wherein the bent band has an elongated portion coplanar with the ellipse and coincident with an extension of the major axis of the ellipse, said handle having an axial bore in which the extension is disposed.

* * * * *